US012660930B2

(12) United States Patent
Shih et al.

(10) Patent No.: US 12,660,930 B2
(45) Date of Patent: Jun. 23, 2026

(54) FOLDABLE ELECTRIC BED

(71) Applicant: Chuan-Hang Shih, Lukang Township, Changhua County (TW)

(72) Inventors: Chuan-Hang Shih, Lukang Township (TW); Yu-Chi Yang, Lukang Township (TW)

(73) Assignee: STAR SEEDS CO., LTD., Taichung City (TW)

( * ) Notice: Subject to any disclaimer, the term of this patent is extended or adjusted under 35 U.S.C. 154(b) by 343 days.

(21) Appl. No.: 18/130,045

(22) Filed: Apr. 3, 2023

(65) Prior Publication Data

US 2024/0197077 A1 Jun. 20, 2024

(30) Foreign Application Priority Data

Dec. 16, 2022 (TW) ..... 111148572

(51) Int. Cl.
*A47C 20/04* (2006.01)

(52) U.S. Cl.
CPC ..... *A47C 20/041* (2013.01)

(58) Field of Classification Search
CPC ..... A47C 20/041
USPC ..... 5/616
See application file for complete search history.

(56) References Cited

U.S. PATENT DOCUMENTS 2,869,614 A * 1/1959 Wamsley ..... A61G 5/006 280/211
3,012,253 A * 12/1961 Reichert ..... A61G 7/002 5/616
3,089,150 A * 5/1963 Briggs ..... A47C 20/08 5/616
3,174,161 A * 3/1965 Black ..... A61G 7/002 5/616
3,414,913 A * 12/1968 Stanley ..... A61G 7/002 5/616
3,644,946 A * 2/1972 Swatt ..... A61G 7/015 5/616
3,821,821 A * 7/1974 Burst ..... A61G 7/002 5/616
3,839,753 A * 10/1974 Benoit ..... A61G 7/002 5/616
3,932,903 A * 1/1976 Adams ..... A61G 7/015 5/100
3,958,283 A * 5/1976 Adams ..... A61G 7/002 5/616

(Continued)

*Primary Examiner* — Justin C Mikowski
*Assistant Examiner* — Luke Hall
(74) *Attorney, Agent, or Firm* — Birch, Stewart, Kolasch & Birch, LLP

(57) ABSTRACT

A foldable electric bed includes a front frame having two parallel guide rails, a rear frame pivotally connected with the front frame and swingable between extended and folded positions, a first buttock supporting unit slidably disposed with the guide rails, a back supporting unit pivotally connected with the first buttock supporting unit, a front link pivotally connected with the front frame and the back supporting unit, and a first actuator disposed with the first buttock and back supporting units, such that the first buttock supporting unit is driven by the back supporting unit to slide forwards when the back supporting unit is driven by the first actuator to swing upwardly. As a result, when the electric bed lifts the back of a user, the user may stay near to the head of the bed.

12 Claims, 8 Drawing Sheets

(56) References Cited

U.S. PATENT DOCUMENTS 4,025,972 A * 5/1977 Adams ..... A61G 7/0509 5/616
4,095,296 A * 6/1978 Ferro ..... A61G 7/015 5/616
4,376,316 A * 3/1983 Mercier ..... A47C 20/041 5/616
4,381,571 A * 5/1983 Elliott ..... A61G 7/015 5/616
4,463,463 A * 8/1984 Kaneko ..... A61G 7/015 5/616
4,675,926 A * 6/1987 Lindblom ..... A61G 7/002 74/606 R
4,712,441 A * 12/1987 Abraham ..... F16H 25/2015 74/412 TA
5,165,129 A * 11/1992 Rohm ..... A61G 7/015 5/616
5,329,657 A * 7/1994 Bartley ..... A47C 20/041 5/616
5,542,744 A * 8/1996 Bathrick ..... A47C 20/041 74/89.41
5,579,550 A * 12/1996 Bathrick ..... A47C 19/005 5/618
5,584,082 A * 12/1996 Crawford ..... A61G 5/006 5/616
5,937,459 A * 8/1999 Binaghi ..... A47C 20/041 254/102
6,088,853 A * 7/2000 Jansen ..... A61G 7/015 5/616
6,276,011 B1 * 8/2001 Antinori ..... A47C 20/041 5/613
6,293,723 B1 * 9/2001 Kiefer ..... B60N 2/929 403/21
6,393,641 B1 * 5/2002 Hensley ..... A47C 20/08 5/616
6,499,162 B1 * 12/2002 Lu ..... A47C 20/08 5/616
6,691,346 B2 * 2/2004 Osborne ..... A61G 7/052 5/616
6,739,004 B1 * 5/2004 Abrahamsen ..... A47C 20/041 74/425
7,025,421 B1 * 4/2006 Fowler ..... A47C 3/36 297/325
7,036,165 B2 * 5/2006 Weinman ..... A61G 7/015 5/617
7,448,100 B1 * 11/2008 Shih ..... A61G 7/015 5/619
7,810,189 B2 * 10/2010 Boudreau ..... A47C 19/22 5/613
7,992,240 B2 * 8/2011 Gladney ..... A47C 21/026 5/617
7,996,939 B2 * 8/2011 Benedict ..... A61G 1/0212 5/614
8,069,512 B2 * 12/2011 Rawls-Meehan ..... A61G 7/015 5/617
8,312,579 B2 * 11/2012 Bock ..... A61G 7/015 5/616
8,615,828 B2 * 12/2013 Schermel ..... A47C 20/04 297/411.31
8,806,682 B2 * 8/2014 Hornbach ..... A61G 7/018 5/619
8,910,328 B2 * 12/2014 Clenet ..... A61G 7/002 5/616
9,009,896 B2 * 4/2015 Suh ..... A47C 19/122 5/618
9,044,366 B2 * 6/2015 Rawls-Meehan ..... A61G 7/018
9,125,776 B1 * 9/2015 Shih ..... A61G 7/018
9,173,793 B2 * 11/2015 Rawls-Meehan ..... A47C 20/08
9,642,760 B2 * 5/2017 Jackson ..... A61G 13/0036
9,763,840 B2 * 9/2017 Rigsby ..... A61G 7/018
10,143,312 B2 * 12/2018 Brosnan ..... A47C 20/041
10,299,976 B2 * 5/2019 Lo ..... A61G 7/015
10,306,994 B2 * 6/2019 Barr ..... A47C 19/025
10,406,050 B2 * 9/2019 Reinke ..... A61G 7/015
10,463,164 B2 * 11/2019 Kramer ..... A47C 20/08
10,568,434 B2 * 2/2020 Kramer ..... A47C 20/041
10,646,390 B2 * 5/2020 Clenet ..... A47C 20/04
11,304,864 B2 * 4/2022 Sweeney ..... A61G 5/14
2002/0178502 A1 * 12/2002 Beasley ..... A61G 7/015 5/618
2003/0052238 A1 * 3/2003 Schneider ..... A47C 20/08 248/421
2004/0020316 A1 * 2/2004 Dewert ..... A47C 20/041 74/89.23
2004/0148704 A1 * 8/2004 Tekulve ..... A61G 7/015 5/618
2005/0210588 A1 * 9/2005 Loewenthal ..... A47C 20/041 5/618
2006/0022500 A1 * 2/2006 Roither ..... A47C 20/041 297/362
2007/0163046 A1 * 7/2007 Eriksson ..... A47C 20/041 5/618
2011/0094032 A1 * 4/2011 Shih ..... A47C 20/041 5/616
2014/0041121 A1 * 2/2014 Shan ..... A47C 21/006 5/618
2014/0053340 A1 * 2/2014 Viberg ..... A47C 20/04 5/657
2014/0123391 A1 * 5/2014 Shan ..... A61G 7/015 5/616
2014/0325759 A1 * 11/2014 Bly ..... A61G 7/015 5/613
2015/0067965 A1 * 3/2015 Xu ..... A61G 7/018 5/616
2015/0107024 A1 * 4/2015 Xu ..... A47C 20/041 5/616
2015/0121623 A1 * 5/2015 Huang ..... A61G 7/018 5/616
2016/0015583 A1 * 1/2016 Dewert ..... A47C 19/12 5/616
2016/0022518 A1 * 1/2016 Shih ..... A61G 7/015 5/616
2017/0071356 A1 * 3/2017 Xu ..... A47C 20/041
2018/0125252 A1 * 5/2018 Chung ..... A47C 20/04
2018/0256423 A1 * 9/2018 Kramer ..... A61G 7/018
2018/0338625 A1 * 11/2018 Nava ..... A47C 19/021
2019/0307621 A1 * 10/2019 Kim ..... A61G 7/005
2020/0029700 A1 * 1/2020 Bratl ..... A47C 20/041
2020/0078238 A1 * 3/2020 Huang ..... A61G 7/012
2020/0214463 A1 * 7/2020 Xie ..... A47C 20/041
2020/0359806 A1 * 11/2020 Wang ..... A47C 21/044
2020/0375368 A1 * 12/2020 Choi ..... A47C 20/04
2020/0397147 A1 * 12/2020 Ren ..... A47C 19/021
2021/0022517 A1 * 1/2021 Bellingroth ..... A47C 19/005
2021/0378411 A1 * 12/2021 Xie ..... A47C 20/041
2022/0095802 A1 * 3/2022 Chen ..... A47C 20/041
2022/0117400 A1 * 4/2022 Zeng ..... A47C 19/12
2022/0248861 A1 * 8/2022 Shan ..... A47C 19/02
2022/0369822 A1 * 11/2022 Ma ..... A47C 19/122

* cited by examiner

FOLDABLE ELECTRIC BED

BACKGROUND OF THE INVENTION

1. Field of the Invention

The present invention relates generally to an electric bed and more particularly, to a foldable electric bed having a slidable function.

2. Description of the Related Art

Conventional electric beds are usually provided with functions of lifting back and legs of the user so as to meet the basic needs of posture adjustment. However, the conventional electric beds may have inconveniences in use. For example, when the electric bed lifts the user's back, the pressure acting on the abdomen of the user will increase as the inclination angle of the user's back increases because the buttocks of the user still remain stationary. For pregnant women or obese people, they will need to adjust their sitting posture during the process of lifting their back to reduce the pressure on their abdomen. If the user is unable to move by himself/herself, a caregiver may need to help the user to adjust his/her posture when the electric bed lifts the user's back, resulting in increase of the burden on the caregiver.

In addition, when conventional electric bed lifts the user's back, the user's shoulder will gradually move away from the head of the bed, resulting in that it is difficult for the user to access items placed on the bedside table or near the head of the bed. If the user wants to easily get the items, the user will need to operate the electric bed to reduce the inclination angle to the user's back. Therefore, the conventional electric bed is inconvenient in use and thus needed to be improved.

Furthermore, because the electric bed needs to adjust the positions and inclined angles of its parts, power mechanisms for driving the parts must be installed in the electric bed. As such, the conventional electric bed is already quite heavy and bulky. If more functions are provided to improve convenience in use, not only more mechanisms will be added, but the overall size and weight will also increase, resulting in higher transportation, storage, and manufacturing costs. As a result, the final market prices of multiple functional electric beds may not be easily accepted by consumers. Therefore, finding a way to balance convenience in use and cost reduction has become an issue to be solved in the industry.

SUMMARY OF THE INVENTION

The present invention has been accomplished in view of the above-noted circumstances. It is an objective of the present invention to provide a foldable electric bed, which can avoid the user's abdomen from oppression when the user's back is lifted, and can be folded to facilitate storage and transportation, thereby reducing cost thereof.

It is another objective of the present invention to provide a foldable electric bed, which will not move the user away from the head of the bed when the user's back is lifted, thereby facilitating the user to take the items around the head of the bed.

To attain the above objectives, the present invention provides a foldable electric bed comprising a front frame, a rear frame, a first buttock supporting unit, a back supporting unit, a front link, and a first actuator. The front frame comprises two guide rails extending in a direction parallel to a front and rear direction. The rear frame comprises a front end pivotally connected with the front frame, such that the rear frame is swingable between an extended position and a folded position. The first buttock supporting unit comprises two slide portions slidably disposed with the two guide rails, respectively. The back supporting unit comprises a rear end pivotally connected with the first buttock supporting unit. The front link has two ends pivotally connected with the front frame and the back supporting unit, respectively. The first actuator has two ends disposed with the first buttock supporting unit and the back supporting unit respectively in a way that the first buttock supporting unit is driven by the back supporting unit to slide forwards when the back supporting unit is driven by the first actuator to swing upwardly. As a result, when the foldable electric bed lifts the back of a user, the user may not move away from the head of the bed, facilitating the user to take the items near the head of the bed and avoiding oppression of the user's abdomen. Further, the foldable electric bed can be conveniently folded to facilitate storage and transportation, and thus reducing the cost thereof.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
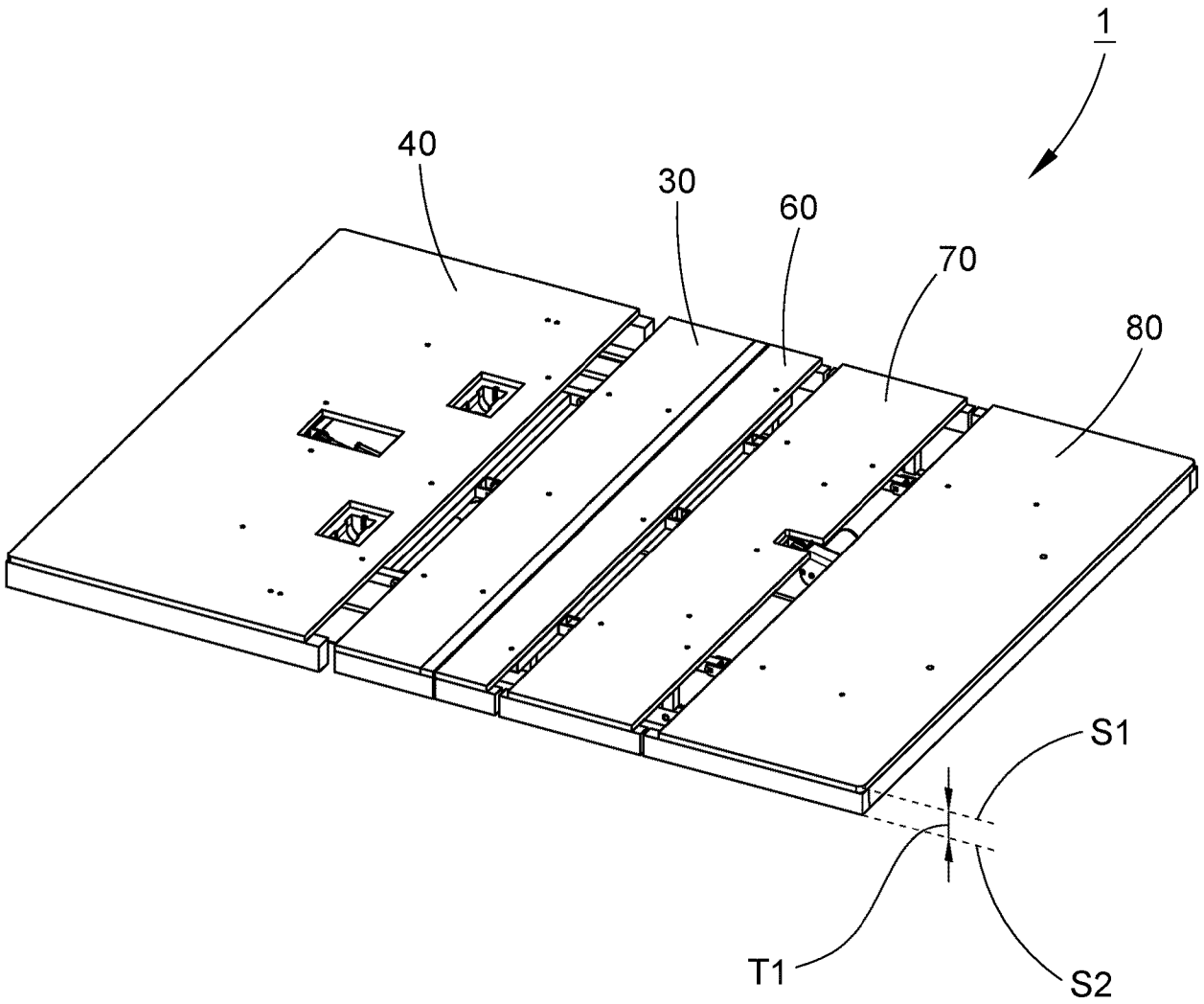
FIG. 1 is a top perspective view of a foldable electric bed according to an embodiment of the present invention in an extended state.
Figure 2:
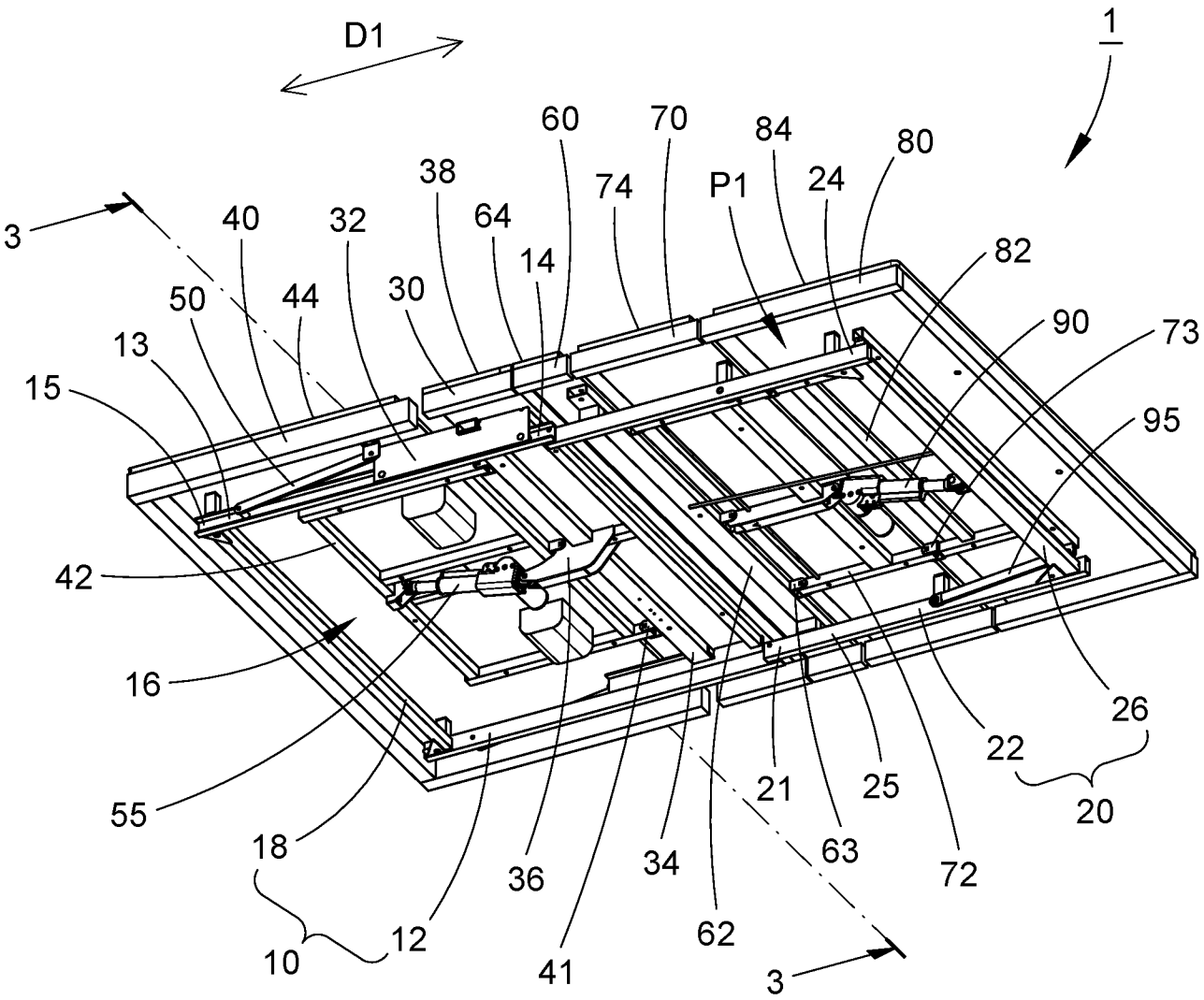
FIG. 2 is a bottom perspective view of the foldable electric bed of the embodiment of the present invention in the extended state.

The structure and technical features of the present invention will be detailedly described hereunder by an embodiment and accompany drawings. As shown in FIGS. 1-2, a foldable electric bed 1 provided in accordance with an embodiment of the present invention comprises a front frame 10, a rear frame 20, a first buttock supporting unit 30, a back supporting unit 40, two front links 50, a first actuator 55, a second buttock supporting unit 60, a thigh supporting unit 70, a lower leg supporting unit 80, a second actuator 90, and two rear links 95.

The front frame 10 includes two guide rails 12 extending in a direction parallel to a front and rear direction D1, and a front transverse rod 18 having two ends connected with front sections 13 of the two guide rails 12, respectively. Each of the two guide rails 12 has a U-shaped cross-section with an opening 15 facing outwardly, as shown in FIG. 2. Further, the aforesaid front and rear direction D1 means the head and tail direction of the foldable electric bed 1, and in the present invention, the front is directed to the direction of the head of the bed and the rear is directed to the direction of the tail of the bed. In another embodiment, the structure of the front frame 10 may be modified as long as it has two parallel guide rails 12.

Figure 5:
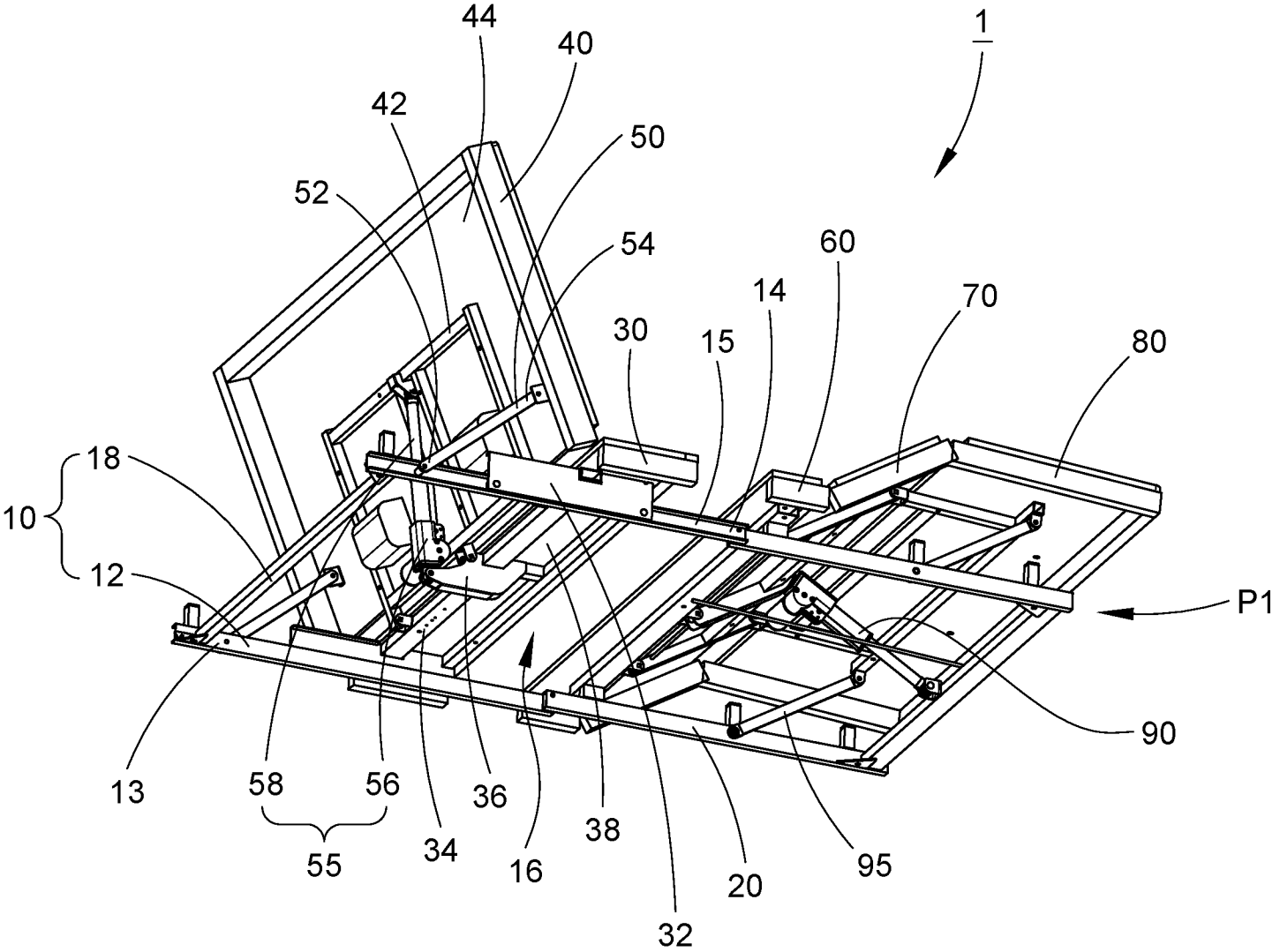
FIG. 5 is a bottom perspective view of the foldable electric bed of the embodiment of the present invention in the state of use.
Figure 6:
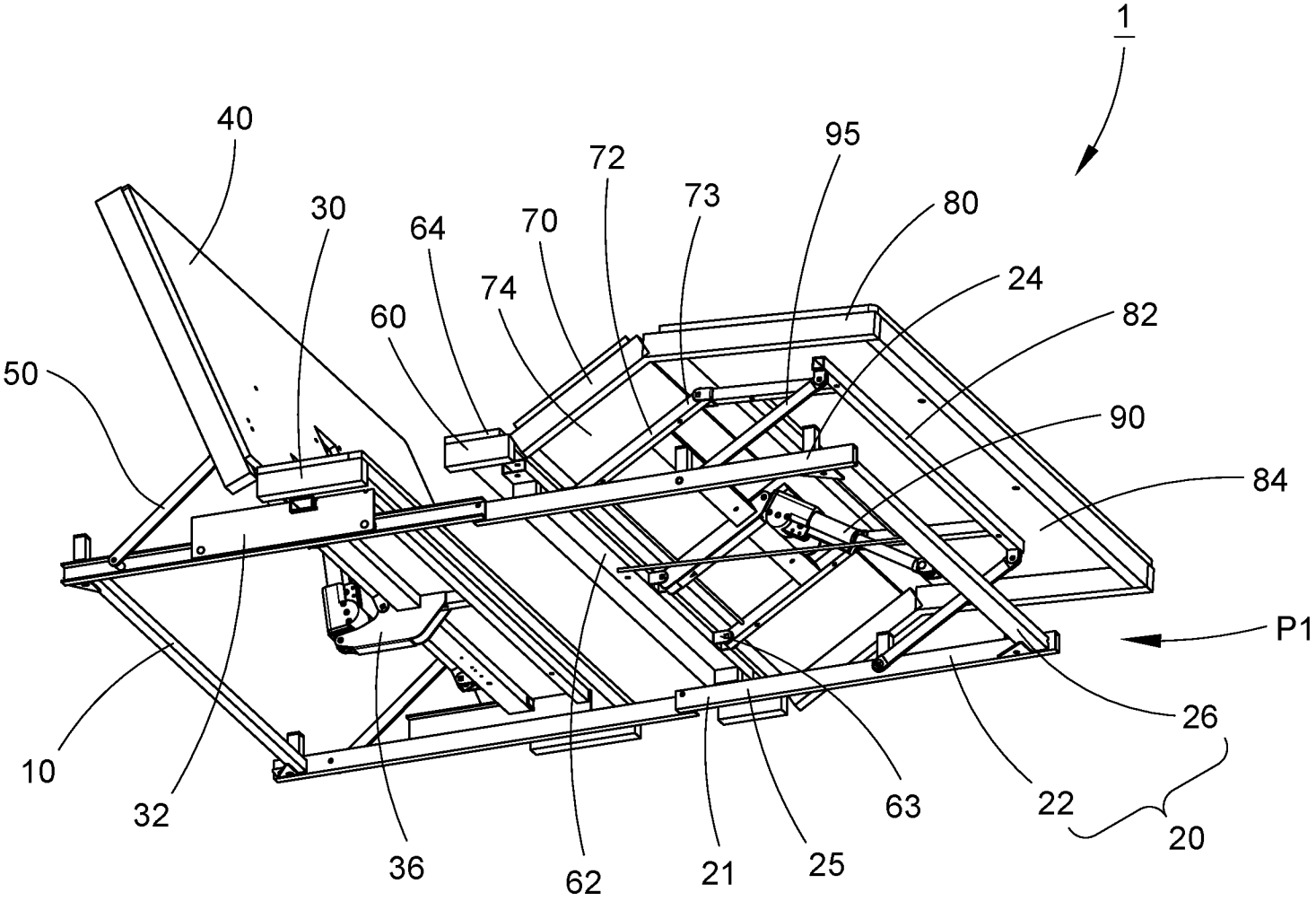
FIG. 6 is another bottom perspective view of the foldable electric bed of the embodiment of the present invention in the state of use.
Figure 7:
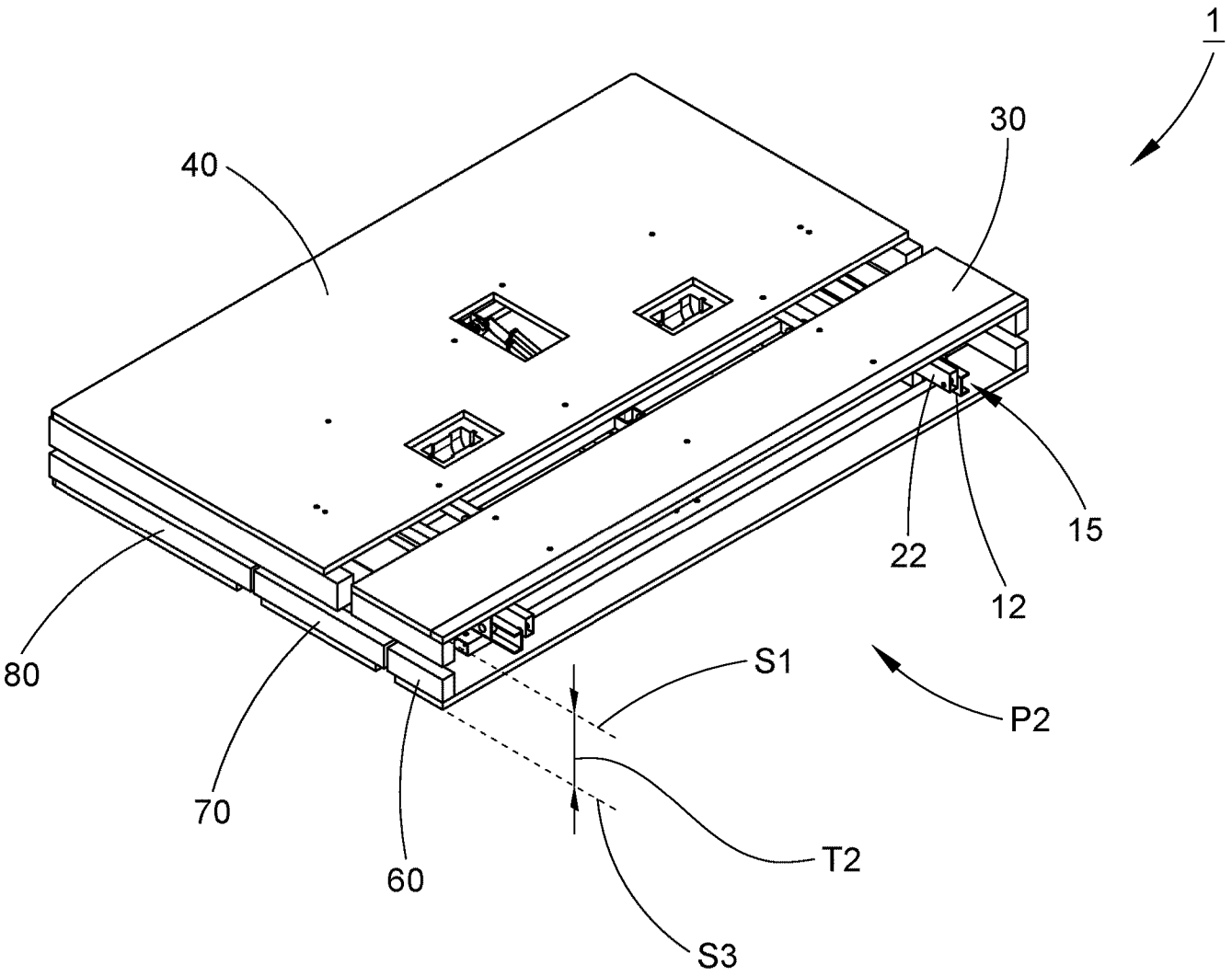
FIG. 7 is a perspective view of the foldable electric bed of the embodiment of the present invention in a folded state.
Figure 8:
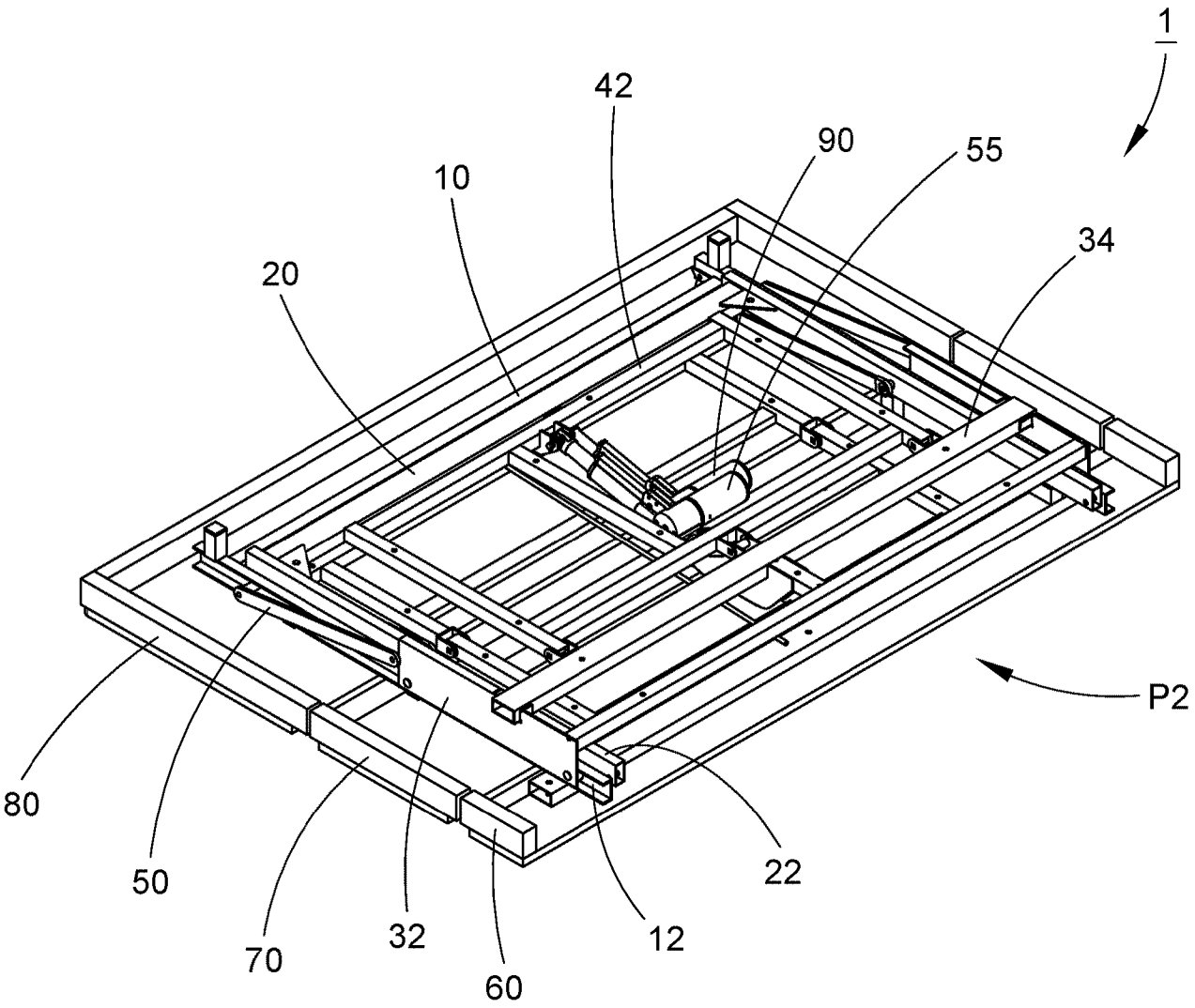
FIG. 8 is a perspective view similar to FIG. 7 but showing that a back supporting plate and a first buttock supporting plate are removed.

The rear frame 20 has a front end 21 pivotally connected with the front frame in such a way that the rear frame 20 is swingable between an extended position P1, as shown in FIGS. 1-6, and a folded position P2, as shown in FIGS. 7-8. The rear frame 20 comprises two longitudinal rods 22 pivotally and respectively connected with the rear ends 14 of the two guide rails 12 at the front thereof, and a rear transverse rod 26. Each of the two longitudinal rods 22 has a rear section 24, and the rear transverse rod 26 has two ends connected with the rear sections 24 of the two longitudinal rods 22, respectively. Specifically, the front ends of the two longitudinal rods 22 are equivalent as the front end 21 of the rear frame 20. When the rear frame 20 stays at the extended position P1, the foldable electric bed 1 is in a fully extending state as shown in FIGS. 1-6. While the rear frame stays at the folded position P2, the rear frame 20 is located in an inside 16 of the front frame 10, as shown in FIG. 8. The so-called inside 16 of the front frame 10 means the space surrounded by the two guide rails 12 and the front transverse rod 18. In another embodiment, the structure of the rear frame 20 may be modified.

Figure 3:
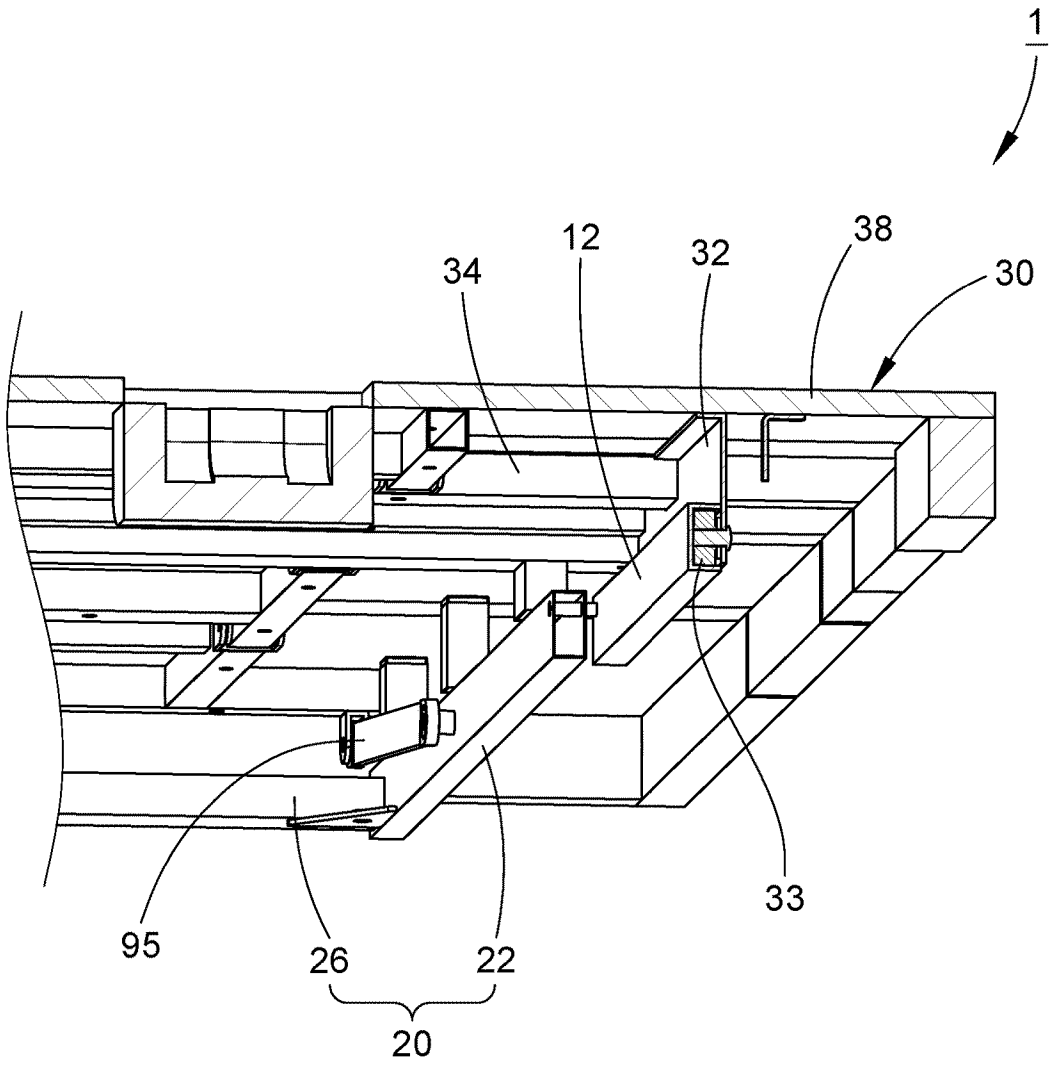
FIG. 3 is a sectional view taken along line 3-3 of FIG. 2.

The first buttock supporting unit 30 comprises two slide portions 32 slidably disposed with the two guide rails 12 respectively, a transversely extending portion 34 having two ends connected with the two slide portions 32, a downwardly extending portion 36, which downwardly extends from a middle section of the transversely extending portion 34, and a first buttock supporting plate 38 disposed on the transversely extending portion 34 to support the user's buttocks or a mattress. The two slide portions 32 are installed with a plurality of rollers 33 rotatably engaged with the two guide rails 12 respectively, as shown in FIG. 3, such that the first buttock supporting unit 30 may slide back and forth along the two guide rails 12. In another embodiment, the rollers 33 may be omitted or replaced by other elements made of engineering plastic as long as the two slide portions may slidably move relative to the two guide rails 12. Further, the first buttock supporting plate 38 may be omitted. In this way, the transversely extending portion 34 may provide the support function, and the structure of the transversely extending portion 34 is not limited to the one disclosed in this embodiment.

The back supporting unit 40 has a rear end 41 pivotally connected with the first buttock supporting unit 30. The back supporting unit 40 includes a back supporting rack 42 having a rear end pivotally connected with the first buttock supporting unit 30, and a back supporting plate 44 disposed on the back supporting rack 42 for supporting the user's back or the mattress. The rear end of the back supporting rack 42 is the rear end 41 of the back supporting unit 40. In another embodiment, the back supporting plate 44 may be omitted, and thus the back supporting rack 42 may provide the support function. Further, the structure of the back supporting rack 42 is not limited to the one disclosed in this embodiment.

Each of the front links 50 has two ends pivotally connected with the front frame and the back supporting unit 40, respectively. Specifically, each front link 50 has a front end 52 pivotally connected with one of the two guide rails 12 of the front frame 10, and a rear end 54 pivotally connected with back supporting plate 44 of the back supporting unit 40. In another embodiment, only one of the two front links 50 is used is sufficient. Furthermore, the front end 52 of the front link 50 may be pivotally connected with another part, such as the front transverse rod 18, of the front frame 10, and the rear end 54 of the front link 50 may be pivotally connected with another part, such as the back supporting rack 42, of the back supporting unit 40.

Figure 4:
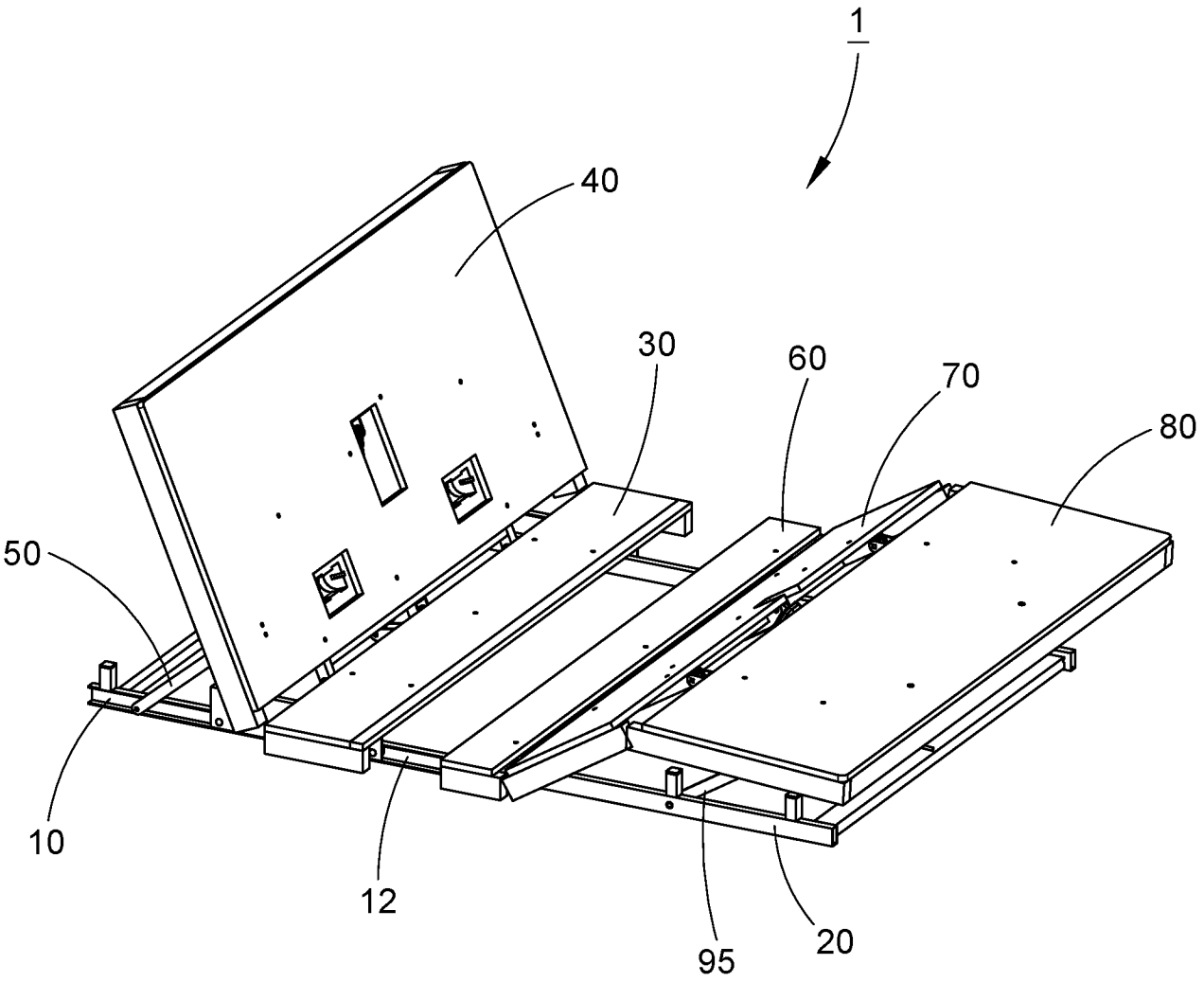
FIG. 4 is a top perspective view of the foldable electric bed of the embodiment of the present invention in a state of use.

The first actuator 55 has two ends disposed with the first buttock supporting unit 30 and the back supporting unit 40, respectively. Specifically, the first actuator 55 is an electric linear actuator comprising a motor 56 and a telescope rod 58. However, the first actuator 55 may be a hydraulic cylinder or a pneumatic cylinder. The motor 56 is pivotally connected with the downwardly extending portion 36 of the first buttock supporting unit 30, and the telescope rod 58 is pivotally connected with the back supporting rack 42. As a result, when the telescope rod 58 extends to lengthen the first actuator 55, the back supporting unit 40 is driven by the actuator 55 to swing upwardly, and in the meantime by means of the two front links 50, the first buttock supporting unit as well as the back supporting unit 40 will slide forwards, i.e. move toward the head of the bed, as shown in FIGS. 4 and 5. On the other hand, when the telescope rod 58 retracts to shorten the first actuator 55, the back supporting unit 40 is driven to swing downwardly, such that the back supporting unit 40 and the first buttock supporting unit slide backwards, i.e. move toward the tail of the bed. The purpose that the motor 56 is disposed with the downwardly extending portion 36 is to increase the arm of force of swinging the back supporting unit 40. In another embodiment, the positions of the motor 56 and telescope rod 58 may be exchanged one from the other, and the first actuator 55 may be installed with another part of the first buttock supporting unit 30 and another part of the back supporting unit 40.

The second buttock supporting unit 60 is disposed with a front section 25 of the rear frame 20 and neighbor with the first buttock supporting unit 30. The second buttock supporting unit 60 includes a buttock supporting rack 62 fixedly connected with the rear frame 20, and a second buttock supporting plate 64 disposed on the buttock supporting rack 62 for supporting the user's buttocks or the mattress. In another embodiment, the buttock supporting rack 62 may be omitted, and thus the second buttock supporting plate 64 may be mounted on the rear frame 20 directly. Alternately, the second buttock supporting plate 64 may be omitted, and thus the rear frame 20 may provide the support function.

The thigh supporting unit 70 is pivotally connected with a rear end 63 of the second buttock supporting unit 60, i.e., the rear end of the buttock supporting rack 62. The thigh supporting unit 70 includes a thigh supporting rack 72 pivotally connected with the buttock supporting rack 62, and a thigh supporting plate 74 mounted on the thigh supporting rack 72 for supporting the user's thighs or the mattress. When the thigh supporting unit 70 stays at a flat posture, the thigh supporting plate 74 is supported by the longitudinal rods 22 of the rear frame 20. In another embodiment, the thigh supporting plate 74 may be omitted, such that the thigh supporting rack 72 provides the support function.

The lower leg supporting unit 80 is pivotally connected with a rear end 73 of the thigh supporting unit 70, i.e., the rear end of the thigh supporting rack 72. The lower leg supporting unit 80 includes a lower leg supporting rack 82 pivotally connected with the thigh supporting rack 72, and a lower leg supporting plate 84 mounted on the lower leg supporting rack 82 for supporting the user's lower legs or the mattress. When the lower leg supporting unit 80 stays at a flat posture, the lower leg supporting plate 84 is supported by the longitudinal rods 22 of the rear frame 20. In another embodiment, the lower leg supporting plate 84 may be omitted, such that the lower leg supporting rack 82 provides the support function.

The second actuator 90 has front and rear ends disposed with thigh supporting rack 72 of the thigh supporting unit 70 and the rear transverse rod 26 of the rear frame 20, respectively. The second actuator 90 is similar in structure to the first actuator 55. Each of the rear links 95 has front and rear ends pivotally connected with one of the longitudinal rods 22 of the rear frame 20 and the lower leg supporting rack 82 of the lower leg supporting unit 80, respectively. As a result, the thigh supporting unit 70 and the lower leg supporting unit 80 can be driven by the second actuator 90 to change their positions. As shown in FIG. 6, when the second actuator 90 is lengthened, the thigh supporting unit 70 is driven to swing upwardly and the lower leg supporting unit 80 is lifted along with the thigh supporting unit 70. On the other hand, when the second actuator 90 is shortened, the thigh supporting unit 70 is driven to swing downwardly, and the lower leg supporting unit 80 is lowered along with the thigh supporting unit 70. In another embodiment, the second actuator 90 may be installed with another part, such as the thigh supporting plate 74, of the thigh supporting unit 70, and can be installed with another part of the rear frame 20. Furthermore, one of the rear links 95 may be omitted. The front end of the rear link 95 may be pivotally connected with another part of the rear frame 20, and the rear end of the rear link 95 may be pivotally connected with another part, such as the lower leg supporting plate 84, of the lower leg supporting unit 80.

With the above-disclosed structural features, when the back supporting unit 40 is driven by the first actuator 55 to swing upwardly, the first buttock supporting unit 30 is driven by the back supporting unit 40 to slide forwards. As a result, when the foldable electric bed 1 lifts the back of a user, the user may not move away from the head of the bed, facilitating the user to take the items near the head of the bed, and the range of support provided by the first buttock supporting unit 30 and the second buttock supporting unit 60 can be increase, thereby avoiding oppression of the user's abdomen. Further, the two guide rails 12 also provide the function of supporting the front frame 10 and strengthening the structural strength of the front frame 10, the structure of the front frame may be made lighter and compact. Moreover, because the first buttock supporting unit can be moved along with the back supporting unit 40, the phenomenon that the user's buttocks sink down due to the loss of support when the user's back is lifted can be avoided. In other words, the foldable electric bed 1 has multiple advantages.

Hereinafter the detail of the foldable function of the electric bed 1 is given. As shown in FIGS. 7 and 8, when the rear frame 20 is swung relative to the front frame 10 to the folded position P2, the second buttock supporting unit 60, the thigh supporting unit 70 and the lower leg supporting unit 80 will swing along with the rear frame 20, such that the electric bed 1 can be arranged in a folded state, thereby facilitating storage and transportation, and thus reducing the cost thereof.

Specifically speaking, as shown in FIG. 1, when the rear frame 20 stays at the extended position P1, the foldable electric bed 1 has a first thickness T1. Further, the top sides of the back supporting unit 40, the first buttock supporting unit 30, the second buttock supporting unit 60, the thigh supporting unit 70 and the lower leg supporting unit 80 are flush with each other and located at a first imaginary plane S1, and the bottom sides of the front frame 10 and the rear frame 20 are flush with each other and located at a second imaginary plane S2 parallel to the first imaginary plane S1. The distance between the first and second imaginary planes S1 and S2 is defined as the first thickness T1. As shown in FIG. 7, when the rear frame 20 stays at the folded position P2, the foldable electric bed 1 has a second thickness T2. At this folded state, the top sides of the back supporting unit 40 and the first buttock supporting unit 30 are still located at the first imaginary plane S1, and the top sides of the second buttock supporting unit 60, the thigh supporting unit 70 and the lower leg supporting unit 80 are flush with each other and located at a third imaginary plane S3 parallel to the first imaginary plane S1. The distance between the first and third imaginary planes S1 and S3 is defined as the second thickness T2. Because the front frame 10 and the rear frame 20 are pivotally connected with each other in a way that the rear frame 20 is located in the inside 16 of the front frame 10 when the rear frame 20 stays at the folded position P2, and the installation positions of the components, such as the first and second actuators 55 and 90, are especially arranged, the folded thickness of the electric bed, i.e. the first thickness T1, will be smaller than twice the non-folded thickness of the electric bed, i.e. the second thickness T2. That is, the relationship of the first and second thicknesses T1 and T2 fulfills the inequality $T1<T2<2T1$. In other words, when the electric bed 1 has been folded, not only the length becomes a half of the original length but the thickness will be less than twice the original thickness. The electric bed 1 of the present invention can be folded in a compact manner with smaller overall volume. For the higher and higher freight and storage costs due to COVID-19 nowadays, the foldable electric bed 1 of the present invention has the advantageous effect of lower cost in transportation and storage.

It is to be further mentioned that when the electric bed 1 stays at the extended state, the bottom sides of all components including the first and second actuators 55 and 90 won't be lower than the second imaginary plane S2 no matter whether or not the back supporting unit 40 and the thigh supporting unit 70 are lifted. As such, the electric bed 1 can be firmly and stably placed on a general bedstead or the ground or floor by the front and rear frames 10 and 20 when it is in use. Further, the overall thickness of the electric bed 1, i.e., the first thickness T1, is very thin, resulting in that the electric bed 1 will occupy less space in the user's room. This is another advantage of the electric bed 1 of the present invention.

Based on the technical features of the present invention, various modifications to the foldable electric beds 1 may be made. For example, the rear frame may be located around an outside of the front frame when the rear frame stays at the folded position. Such variations are not to be regarded as a departure from the spirit and scope of the invention, and all such modifications as would be obvious to one skilled in the art are intended to be included within the scope of the following claims.

What is claimed is:

1. A foldable electric bed, comprising:

a front frame comprising two guide rails extending in a direction parallel to a front and rear direction;

a rear frame pivotally connected with the front frame, such that the rear frame is swingable between an extended position and a folded position;

a first buttock supporting unit comprising two slide portions slidably disposed with the two guide rails, respectively;

a back supporting unit pivotally connected with the first buttock supporting unit;

a front link pivotally connected with the front frame and the back supporting unit; and a first actuator disposed with having two ends pivotally and directly connected with the first buttock supporting unit and the back supporting unit, respectively, in a way that the first buttock supporting unit is drivenable by the back supporting unit to slide forwards and the back supporting unit is drivenable by the first actuator to swing upwardly.

2. The foldable electric bed as claimed in claim 1, wherein when the rear frame stays at the folded position, the rear frame is located in an inside of the front frame.

3. The foldable electric bed as claimed in claim 1, wherein the front frame comprises a front transverse rod, and each of the two guide rails comprises a front section; the front transverse rod is connected between the front sections of the two guide rails.

4. The foldable electric bed as claimed in claim 1, wherein the rear frame comprises two longitudinal rods pivotally and respectively connected with the two guide rails, and a rear transverse rod; each of the two longitudinal rods has a rear section, and the rear transverse rod is connected between the rear sections of the two longitudinal rods.

5. The foldable electric bed as claimed in claim 1, wherein the first buttock supporting unit comprises a transversely extending portion connected with the two slide portions, and a downwardly extending portion, which downwardly extends from the transversely extending portion and is pivotally connected with the first actuator.

6. The foldable electric bed as claimed in claim 1, wherein the two slide portions are installed with a plurality of rollers rotatably engaged with the two guide rails, respectively.

7. The foldable electric bed as claimed in claim 1, wherein the front link comprises a front end pivotally connected with the front frame, and a rear end pivotally connected with the back supporting unit.

8. The foldable electric bed as claimed in claim 1, wherein the back supporting unit comprises a back supporting rack pivotally connected with the first buttock supporting unit and the first actuator.

9. The foldable electric bed as claimed in claim 1, further comprising a second buttock supporting unit, which is disposed with a front section of the rear frame and adjacent to the first buttock supporting unit.

10. The foldable electric bed as claimed in claim 9, further comprising a thigh supporting unit, a lower leg supporting unit, a second actuator and a rear link; the thigh supporting unit is pivotally connected with the second buttock supporting unit; the lower leg supporting unit is pivotally connected with the thigh supporting unit; the second actuator is disposed with the thigh supporting unit and the rear frame; the rear link is pivotally connected with the rear frame and the lower leg supporting unit, such that the thigh supporting unit and the lower leg supporting unit are drivenable by the second actuator to change their positions.

11. The foldable electric bed as claimed in claim 10, wherein when the rear frame stays at the extended position, the foldable electric bed has a first thickness; when the rear frame stays at the folded position, the foldable electric bed has a second thickness, which is greater than the first thickness and smaller than twice the first thickness.

12. The foldable electric bed as claimed in claim 11, wherein when the rear frame stays at the extended position, top sides of the back supporting unit, the first buttock supporting unit, the second buttock supporting unit, the thigh supporting unit and the lower leg supporting unit are flush with each other and located at a first imaginary plane, and bottom sides of the front frame and the rear frame are flush with each other and located at a second imaginary plane parallel to the first imaginary plane in a way that a distance between the first and second imaginary planes is defined as the first thickness; wherein when the rear frame stays at the folded position, the top sides of the back supporting unit and the first buttock supporting unit are still located at the first imaginary plane, and the top sides of the second buttock supporting unit, the thigh supporting unit and the lower leg supporting unit are flush with each other and located at a third imaginary plane parallel to the first imaginary plane in a way that a distance between the first and third imaginary planes is defined as the second thickness.

* * * * *